US008467551B2

(12) United States Patent
Turnbull et al.

(10) Patent No.: US 8,467,551 B2
(45) Date of Patent: Jun. 18, 2013

(54) VEHICULAR DIRECTIONAL MICROPHONE ASSEMBLY FOR PREVENTING AIRFLOW ENCOUNTER

(75) Inventors: Robert R. Turnbull, Holland, MI (US); Alan R. Watson, Buchanan, MI (US); Michael A. Bryson, Hudsonville, MI (US)

(73) Assignee: Gentex Corporation, Zeeland, MI (US)

( * ) Notice: Subject to any disclaimer, the term of this patent is extended or adjusted under 35 U.S.C. 154(b) by 511 days.

(21) Appl. No.: 12/847,189

(22) Filed: Jul. 30, 2010

(65) Prior Publication Data

US 2012/0027241 A1 Feb. 2, 2012

(51) Int. Cl.
*H04R 1/02* (2006.01)

(52) U.S. Cl.
USPC ..... 381/189; 381/87; 381/335; 381/91; 381/345; 381/351; 381/359

(58) Field of Classification Search
USPC ..... 381/87, 335, 91, 345, 351, 359, 189
See application file for complete search history.

(56) References Cited

U.S. PATENT DOCUMENTS

| | | | | |
|---|---|---|---|---|
| RE30,736 | E * | 9/1981 | Hiyoshi et al. | 84/604 |
| RE35,813 | E * | 6/1998 | Usa et al. | 84/606 |
| 2005/0025328 | A1* | 2/2005 | Song | 381/369 |
| 2010/0177908 | A1 | 7/2010 | Seltzer et al. | |
| 2010/0272302 | A1* | 10/2010 | Feiertag et al. | 381/361 |
| 2012/0027234 | A1* | 2/2012 | Goida | 381/150 |
| 2012/0027241 | A1* | 2/2012 | Turnbull et al. | 381/365 |
| 2012/0087530 | A1* | 4/2012 | Hawker et al. | 381/361 |
| 2012/0177229 | A1* | 7/2012 | Lorenz et al. | 381/111 |
| 2012/0330652 | A1* | 12/2012 | Turnbull et al. | 704/226 |

FOREIGN PATENT DOCUMENTS

| | | |
|---|---|---|
| JP | 10210121 | 8/1998 |
| JP | 2007038790 | 2/2007 |
| WO | WO2005013641 | 2/2005 |

OTHER PUBLICATIONS

Michael L. Seltzer and Ivan Tashev, A Log-MMSE Adaptive Beamformer Using a Nonlinear Spatial Filter, Speech Technology Group, Microsoft Research, Redmond, WA 98052, {mseltzer, ivantash} @microsoft.com, Sep. 2008, 4 pages.

"Phase-Based Dual-Microphone Robust Speech Enhancement"; IEEE Transactions on Systems, Man, and Cybernetics—Part B Cybernetics, vol. 34, No. 4; Aug. 2004, pp. 1763-1773.

"A Cross-Spectrum Weighting Algoritm for Speech Enhancement and Array Processing: Combining Phase-shift Information and Stationary Signal Properties", Journal of the Acoustical Society of America, 119(2), Feb. 2006, pp. 952-964.

Patent Cooperation Treaty, International Searching Authority, International Search Report, Written Opinion of the International Searching Authority and Notification of Transmittal, Apr. 6, 2012, 11 Pages.

* cited by examiner

*Primary Examiner* — David S. Warren
(74) *Attorney, Agent, or Firm* — Price Heneveld LLP; Scott P. Ryan

(57) ABSTRACT

A microphone mounting assembly (800A/**800*b*) include one or more transducers (801) mounted to a printed circuit board (PCB) (805) where a spacer (803) is used having a channel (807) positioned on the PCB (805) for allowing acoustical energy to pass through the channel (807) to a port (809) in the PCB (805). A first cover (811) is positioned over the channel (807) for disrupting the direct encounter with airflow into the channel (807) while a top section (813) having a second cover (815) is further positioned adjacent to the first fabric cover (811) for preventing debris from obstructing the first fabric cover (811**).

27 Claims, 6 Drawing Sheets

VEHICULAR DIRECTIONAL MICROPHONE ASSEMBLY FOR PREVENTING AIRFLOW ENCOUNTER

FIELD OF THE INVENTION

The present invention relates generally to microphones and more particular a microphone used with a digital signal processor in a vehicular mirror.

BACKGROUND

Microphones used in automobiles are known in the art and may be placed in various locations throughout the vehicle in order to provide the driver with the ability to verbally control functionality of telematics, mobile telephone and other electronic devices within the vehicle. Often, these microphones are placed in the vehicle's rear view mirror so as provide improved performance and save space in the vehicle's instrument console.

Prior art automotive microphones have typically used a directional transducer with the peak polar response pointed directly at the driver or alternatively pointed at a location that is substantially down the center of the vehicle's passenger compartment or cabin. While this technique might help to maximize voice amplitude levels, it does not always maximize the signal-to-noise ratio (SNR) at the microphone. Those skilled in the art will recognize that the interior acoustic environment in an automobile is highly reverberant. This results in standing acoustical wave patterns that give rise to non-uniform sound pressure distributions at the microphone location. While the optimum SNR microphone aim angle is vehicle specific, in most cases the desired aim point of a single microphone or microphone system may be at some other location within the vehicle.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
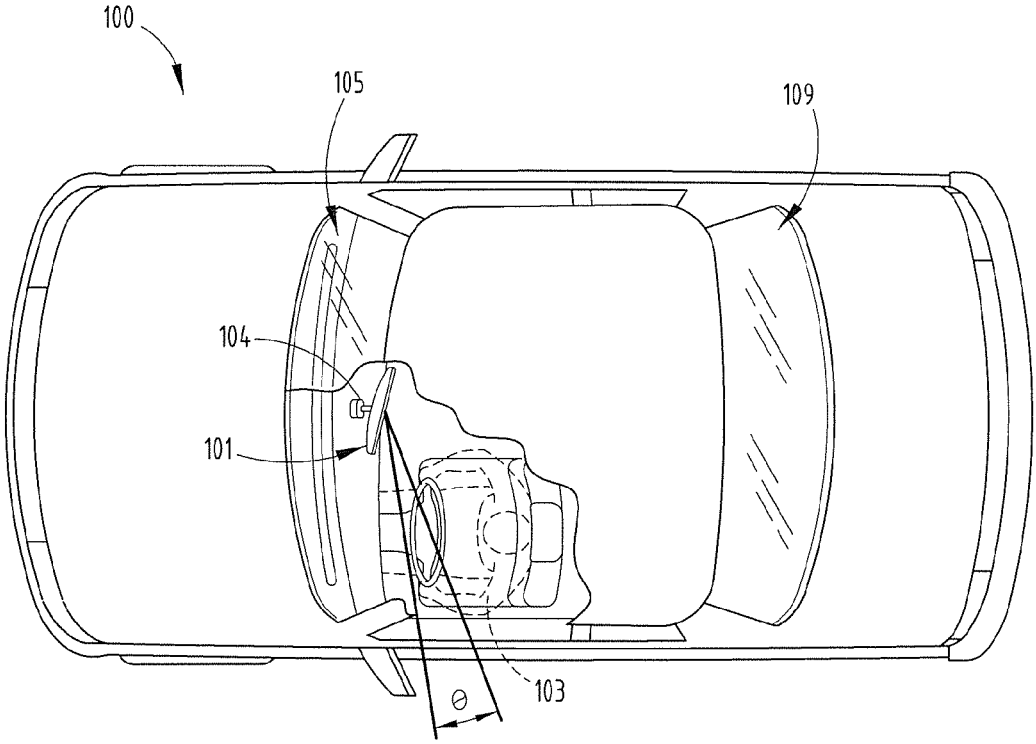
FIG. 1 is a top view of the inside of a vehicle showing the orientation of the driver and rear view mirror.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE PREFERRED EMBODIMENTS

Before describing in detail embodiments that are in accordance with the present invention, it should be observed that the embodiments reside primarily in combinations of method steps and apparatus components related to a vehicular microphone system using space time processing. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of a vehicular microphone system described herein. The non-processor circuits may include, but are not limited to signal drivers, clock circuits, power source circuits, and user input devices. As such, these functions may be interpreted as steps of a method to perform functions in a vehicular microphone system. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The microphone assemblies of the present invention are generally associated with an interior rear view mirror offering superior performance in the presence of noise. The microphone assemblies operate to enhance the performance of hands-free devices which they are associated, including applications where the vehicle acoustics are highly sensitive such as voice recognition for a vehicle telematics or a telecommunication system. This occurs, amongst other things, by improving the signal-to-noise ratio of an output of the microphone assembly. The vehicle microphone assembly works to eliminate acoustic and mechanically induced noise for providing greater utility with regard to their use in vehicle telematics and other electronic devices having a microphone input. Additionally, analog and/or digital circuitry can be selected for use with the microphone transducer for enabling the transducer to generate an audio signal output that has a high signal-to-noise ratio.

FIG. 1 illustrates a top view of the interior of a vehicle. The vehicle 100 includes an interior rear view mirror assembly 101 by which the vehicle operator 103 (illustrated in phantom) can view a portion of the road behind the vehicle 100 without having to turn around to look rearward. The rear view mirror assembly 101 is mounted to the vehicle windshield 105, or the vehicle's headliner, via a mirror mounting support 104, in a conventional manner that facilitates electrical connection of the rear view mirror to the vehicle's electrical system and permits driver adjustment of the mirror-viewing angle. The interior rear view mirror assembly 101 includes a single microphone generally aimed to capture a user voice and other audible information in a range generally defined by angle $\phi$ that is generally reflected off or from the driver's side window. Alternatively, in multiple microphone embodiments as described herein, the microphone beamwidth can be much narrower for aiming directly at the driver's head and face. This is in contrast to the single microphone embodiment that can achieve better overall SNR while pointed at the driver's side window in some vehicles. Further, the rear view assembly 101 as used for the various microphone embodiments as described herein may also be associated with a windshield console or overhead console as used within the vehicle.

Figure 2:
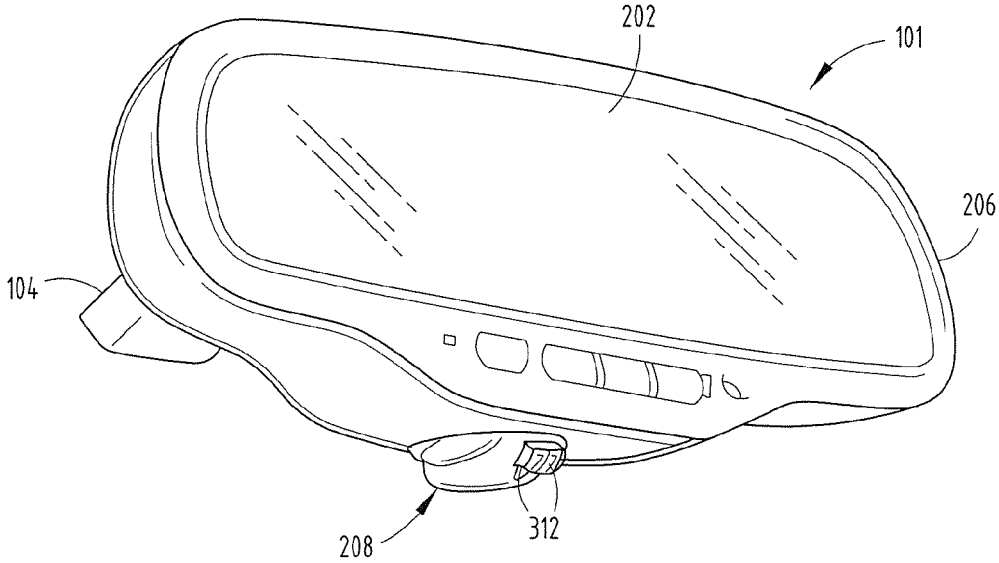
FIG. 2 is a perspective view of the rear view mirror assembly showing porting of the microphone audio.

FIG. 2 illustrates an enlargement of the rear view mirror assembly 101. The mirror assembly 101 includes an elongated housing 206 pivotably carried on mirror support 104. The mirror 202 may be any conventional interior rear view mirror, such as a prismatic mirror of the type used with a mirror housing manually adjustable for daytime and nighttime operation, a multiple element mirror effecting automatic reflectivity adjustment, such as an electrooptic or electrochromic mirror or a video display. The elongated housing 206 may be of any conventional manufacture such as integrally molded plastic.

The rear view mirror assembly 101 further includes a microphone assembly 208 that is preferably mounted to the housing 206 at a location visible to the vehicle driver 103 or at a position which is a direct line of sight between the speaker's mouth and the microphone. It is advantageous for the microphone assembly 208 to be positioned on the mirror housing 206 as the mirror assembly is movably carried on the support 104. The driver 103 (FIG. 1) will typically adjust the position of the mirror 202 and housing 206 to reflect images visible through the rear window 109 of the vehicle 100. When making such an adjustment for viewing angle, the driver 103 adjusts the mirror 202 towards his or her eyes by moving the housing 206 which will simultaneously direct the front of microphone assembly 208 toward the driver. However, the microphone assembly could be mounted in other vehicle accessories, such as a visor, an overhead console, a vehicle trim component such as a headliner or an A-pillar cover, a center console, or the like.

Figure 3:
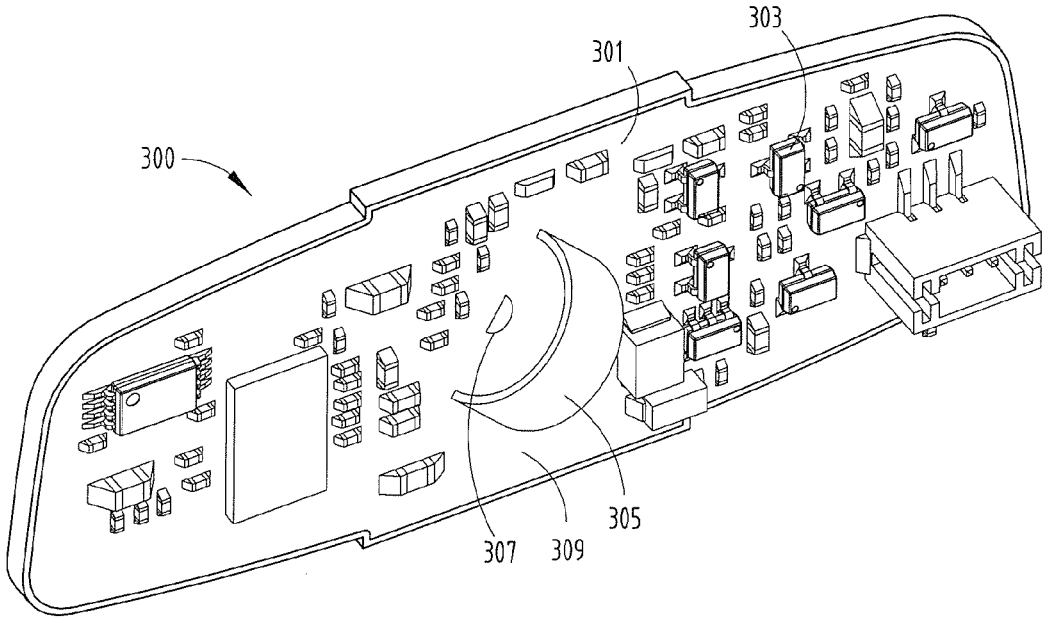
FIG. 3 is a front perspective view of an embodiment of a printed circuit board used in the rear view mirror assembly showing the use of one directional microphone.
Figure 4:
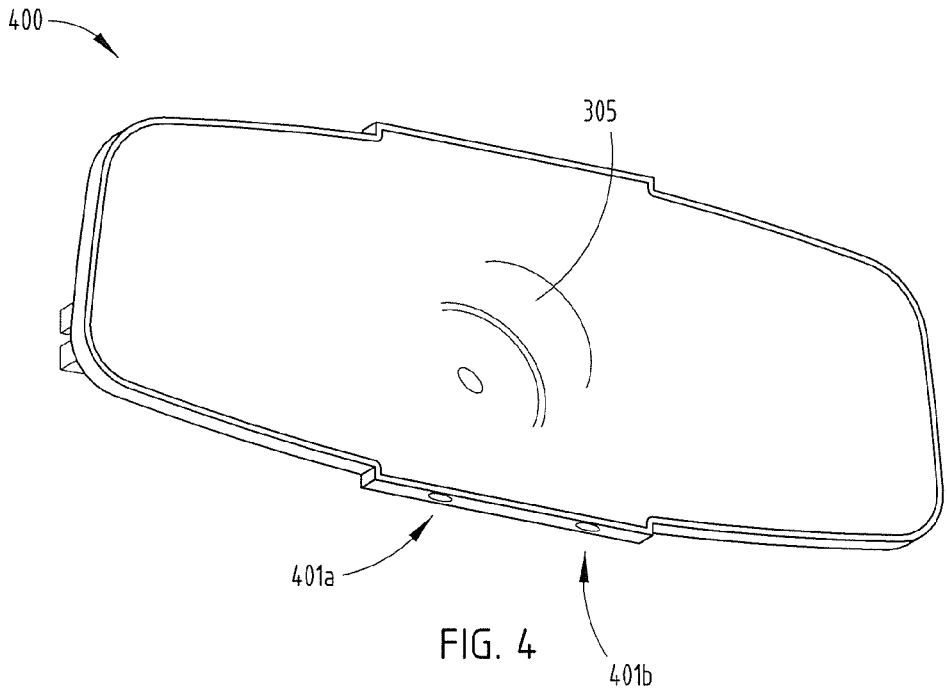
FIG. 4 is a rear perspective view of the printed circuit board shown in FIG. 3.

FIGS. 3 and 4 illustrate front and rear perspective views respectively of an interior rear view mirror circuit board assembly for use within a vehicular rear view mirror. The front circuit board assembly 300 includes a printed circuit board 301 that includes a plurality of electrical components 303 as well as a unidirectional microphone transducer 305 located on the circuit board assembly 300. In operation, the microphone 305 may be located at substantially the center of the circuit board 301 and includes one or more audio input ports 307. The microphone 305 may be tilted or skewed while positioned on the board 301 so that its sensitivity peak is rotated by approximately eight (8) degrees from the mirror face 309. This has the effect of enhancing its directivity toward a particular location in the vehicle. This type of selective positioning or sensitivity peak rotation preferably will be directed toward the driver's seat position or driver's side window for optimizing SNR. The output from the transducer 305 can be amplified using an analog amplification stage or further processed using an analog filtering technique or digital signal processing (DSP) to further improve SNR. Any signal processing performed in the microphone must be compatible with downstream noise reduction, echo cancellation and voice recognition. Additionally, the signal processing algorithms in the microphone should not introduce excessive delay. Too much delay will degrade the performance of downstream acoustic echo cancelation.

As seen in FIG. 4, the rear view of the interior rear view mirror assembly 400 illustrates the acoustic porting 401*a*, 401*b* used to direct the users voice towards the microphone 305. Thus, the best SNR "aim point" may not be directly at the driver when using a single directional element. It should be evident to those skilled in the art that the microphone transducer 305 can be mounted either on the front or rear of the PC board 301 with acoustic porting at the top or bottom of the PC board assembly so to as to direct acoustic waves in the audio spectrum toward the microphone 305.

Figure 5:
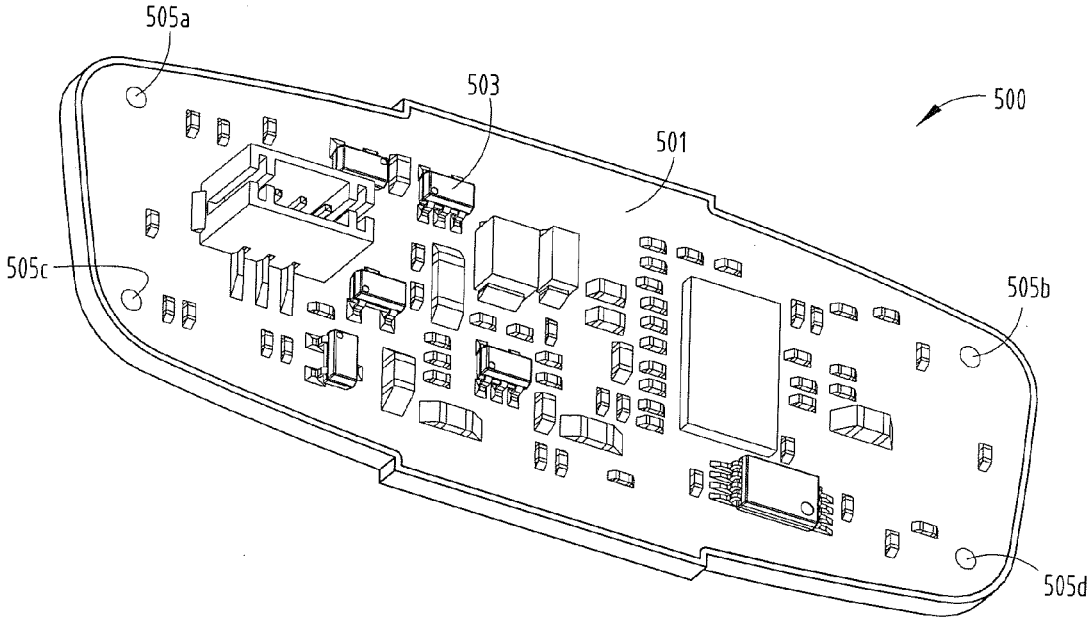
FIG. 5 is a front perspective view of an embodiment of a printed circuit board assembly using four omnidirectional microphones.
Figure 6:
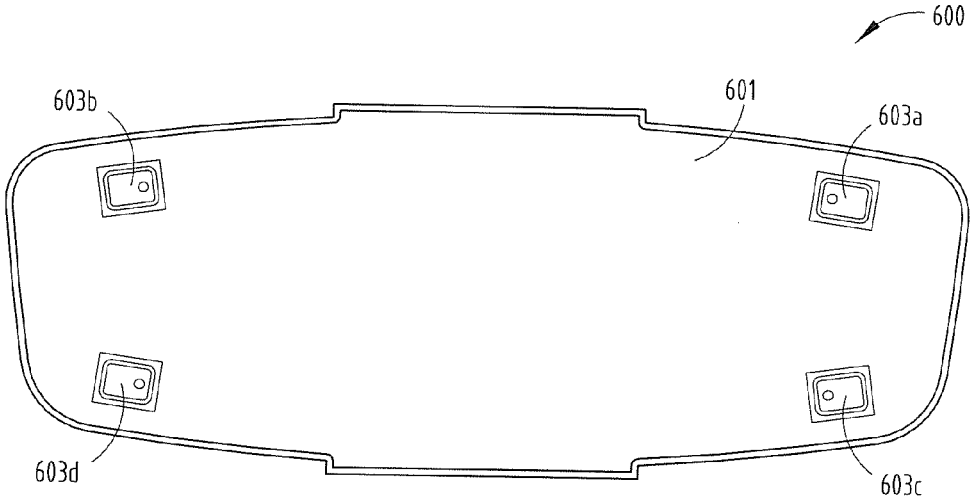
FIG. 6 is a rear perspective view of the printed circuit board shown in FIG. 5.

FIGS. 5 and 6 illustrate an alternative embodiment of the front and rear perspective views respectively of an interior rear view mirror circuit board assembly using multiple microphones for use within a vehicular rear view mirror. The interior rear view mirror circuit board assembly 500 includes a printed circuit board 501 populated with a plurality of electronic components 503. At each corner end of the PCB 501, a plurality of porting apertures 505*a*, 505*b*, 505*c* and 505*d* are used to direct or port sound and acoustical signals to microphones positioned on the front side of the PCB 501. Alternatively, the microphones may be positioned on the back of the PCB 501. Rather than using a single directional transducer like that shown in FIGS. 1 and 2, a directional polar gain pattern may be generated using two or more omnidirectional or unidirectional elements. The size and position of the microphones on the board can be used to provide a desired amount of directivity and increase acoustical efficiency. As seen best in FIG. 5, the microphone system 600 is mounted on the front of the PCB 501 with ports to the back side of PCB 501. The directional pattern may be created using a combination of directional elements and/or by a combination of omnidirectional and directional elements. Microphone transducers 603*a*, 603*b*, 603*c* and 603*d* are oriented on the surface of the PCB 501 to receive sound through their respective porting aperture and may be electret, capacitor, dynamic, micro-electromechanical system (MEMS) or other types. The use of MEMS microphones is particularly attractive as this type of microphone lends itself well to high volume manufacturing. While directional MEMS microphones exist, the omnidirectional MEMS type microphone is more common and technologically mature for applications as described herein.

Moreover, MEMS transducers are typically smaller than the other transducer types and have better gain and phase stability over time and temperature. As seen in FIG. 5, printed circuit board (PCB) mount MEMS transducers can be used that admit or port sound through a hole in the PCB so that the transducer can be mounted on the opposite side of the PCB from the acoustic port. This is useful in protecting the microphone assembly from electrostatic discharge (ESD). In operation, the acoustic port must be exposed to the environment to admit sound, but the microphone electronics need to be isolated from the environment for ESD protection. By utilizing a transducer that ports sound through the PCB, all of the electronic components can be placed on one side of the PCB which can then be protected by an enclosure (not shown). As seen in FIG. 6, the electrically grounded structure can surround the acoustic port to prevent ESD entering through the acoustic port on the exposed side of the PCB. As will be evident to those skilled in the art, one additional benefit of porting through the PCB is that the volume of the cavity formed by the PCB, gasket and windscreen can be reduced. Additional solutions for preventing ESD damage includes the use of a metalized plastic shield. Connections may need to be made through openings in the shield while minimizing RF leakage and ESD paths.

Figure 7A:
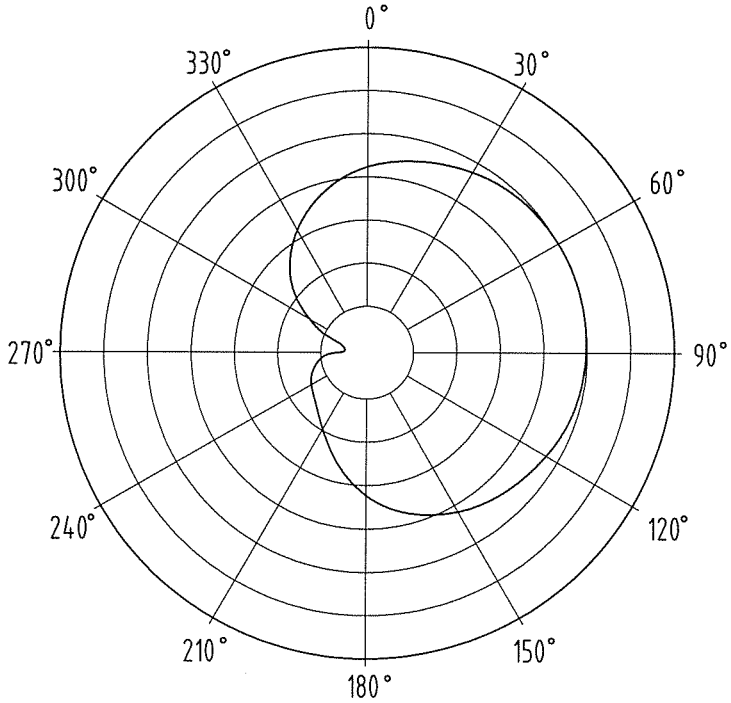
FIGS. 7A and 7*b* illustrate examples of polar plots showing a possible directivity pattern of the microphone(s) as shown in FIG. 3 and FIG. 5 respectively.
Figure 7B:
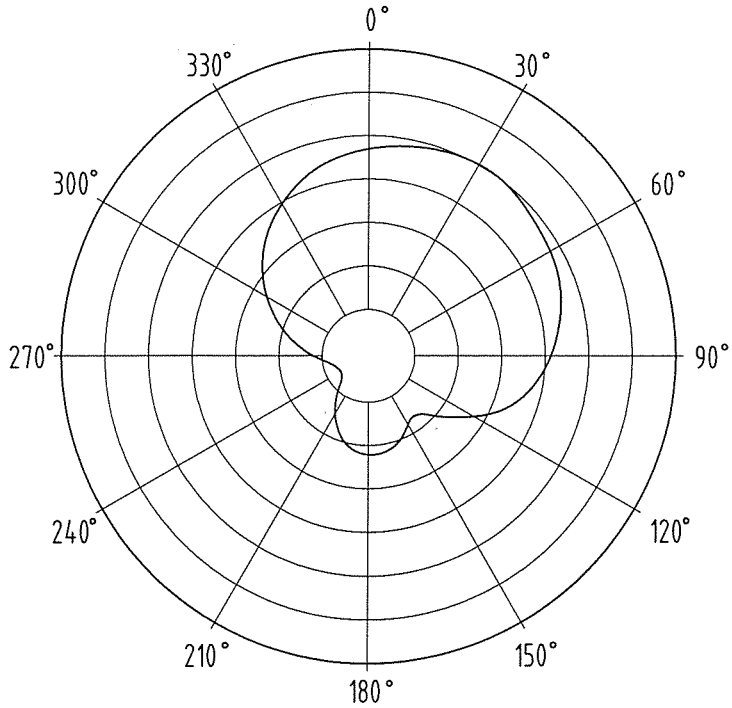

FIGS. 7A and 7B illustrate polar plots of various embodiments of the invention showing steering of the microphone arrays shown in FIG. 3 and FIG. 5, respectively. FIG. 7A illustrates the directivity of a single microphone typically placed at the center of the PC board. The plot of the single microphone embodiment shows the microphone directivity at 1 kHz having a substantially broad beam width with the center of its beam pointed at approximately 70 to 75 degrees from a microphone centerline. This directs or aims the microphone beam toward the driver's side window which has shown to be optimal in a single microphone transducer embodiment. This occurs since a single microphone element has a broad acceptance angle. In a vehicle, the driver's voice signal that reaches the microphone contains many components. These components include the direct audible sound, sound reflected sounds off the driver's chest and sound reflected off the driver's window, windshield, dashboard, headliner, etc. There is also noise that emanates from different locations that has its own direct and reflected signal combination. In some cases, the reflected signal off the driver's window can add a lot of signal to the "direct" path while the background noise increases to a lesser amount. By pointing the single microphone at the window, this single element is able to receive both the direct and driver window reflection voice signals in nearly equal amounts providing a net gain in the audible signal level. Further, it should be recognized that there can also be some signal loss depending on the frequency and path length to the microphone However, this technique using a singe microphone transducer typically provides a net voice signal gain at the microphone input. In contrast, FIG. 7B illustrates the directivity at 1 kHz of a four microphone array embodiment having a narrower beamwidth than the single microphone embodiment. This narrower beamwidth allows the microphone to be pointed substantially toward the driver at approximately 35 to 40 degrees from a microphone center line pointing down middle of the vehicle.

Further, since an optimum polar aim point is a function of frequency, it is desirable to be able to control the polar response as a function of frequency. While it is possible to generate directional polar responses, e.g. beamforming using only amplitude adjustment and phase shift circuits, a more flexible approach is to perform beamforming in the frequency domain. In this approach, the output from each microphone, as shown in FIG. 5, is digitized and transformed into the frequency domain using a fast Fourier transform (FFT) or filter bank. Each frequency group or "bin" is multiplied by a complex weight before being summed with the other transformed and weighted microphone outputs for that bin.

As seen in the equation below, the variable "beam" contains the beamformed output for each FFT or filter bank band. The variable "mic" for these various frequency bands, contains the time domain data transformed into the frequency domain with both a real and imaginary value for each microphone. The first subscript is the mic element index, the second subscript is the FFT history buffer index and the third subscript is the FFT band index. The variable "weight" contains the complex gain for each microphone.

```
for band=1, nBands
{beam(band) = 0
for fft=1, nFFT
{for mic=1, nMic
(beam(band) = beam(band) + mic(mic,fft,band)*weight(mic,fft,band)}}}
```

This sum is the beamformed output where each frequency bin can have its own primary direction or "aim point" for maximizing signal-to-noise (SNR) for each frequency band and thus an improved total SNR. For instance, at some frequencies the best aim point may be with the beam gain peak directed at the driver but at other frequencies the best aim point may be with the gain peak at the driver's window or down the vehicle center. Further, those skilled in the art will also recognize that it is possible to calculate multiple polar responses for a single array. A single array located in the mirror can target two locations in the vehicle, i.e., one maximizing the driver signal and another maximizing the passenger signal. Alternatively, the processor can provide a single output while selecting a passenger signal, driver signal or both depending on priority or the relative or absolute signal levels.

In order to facilitate production testing, it is desirable that the microphone be able to convey or transmit some type of identification data such as part number, code revision, calibration data etc. so that this data can be used to interface the microphone into automotive or telematics type systems. In many cases it is also desirable to interface a DSP based microphone to a system originally designed for an analog microphone. Two analog interfaces that are commonly used in automotive applications are a) a two wire VDA standard for combined audio and power; and b) a three wire interface with power, ground and audio output. Optimally, the microphone might send test data at the beginning of each power cycle or when triggered by some external stimulus. This stimulus might include but is not limited to an audio signal received by one or more of the microphone transducers. Alternatively, the stimulus may be the alteration of the microphone power supply voltage to a value outside its normal operating range. The data transmission scheme may operate using a digital zero/digital one (0/1) modulation of the microphone output or alternatively by using a modulated tone. However, as it is also possible for data transmission to be accidentally triggered by any number of events including electro-magnetic interference (EMI), electro-static discharge (ESD) or a brief power interruption, a data transmission method which does not interrupt normal audio transmission is more desirable.

Hence, by modulating a tone outside normal telephone bandwidth (300 Hz-3400 Hz), data can be transmitted while still passing audio in a normal manner. As an example, data could be modulated on a 7 kHz carrier which would be rejected by the telephone system. The modulation scheme needs to be selected so that the modulation sidebands remain outside normal telephone bandwidth so as to prevent audibility through the telephone system. Possible coding methods that can be used include but are not limited to pulse width modulation (PWM), Manchester and Run Length Limited (RLL) coding. Alternatively, the data could be modulated on a low frequency carrier (for example 100 Hz) such that this type of low frequency carrier signal would also be inaudible through the telephone system.

Figure 8A:
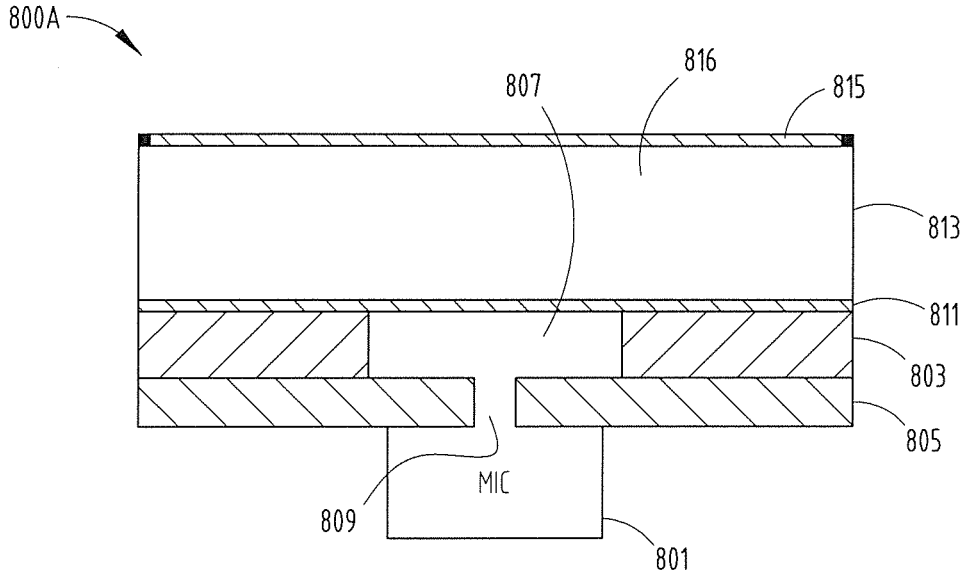
FIGS. 8A and 8B are side cross-sectional views illustrating various embodiments of the microphone assembly as used in FIG. 3 and FIG. 5.
Figure 8B:
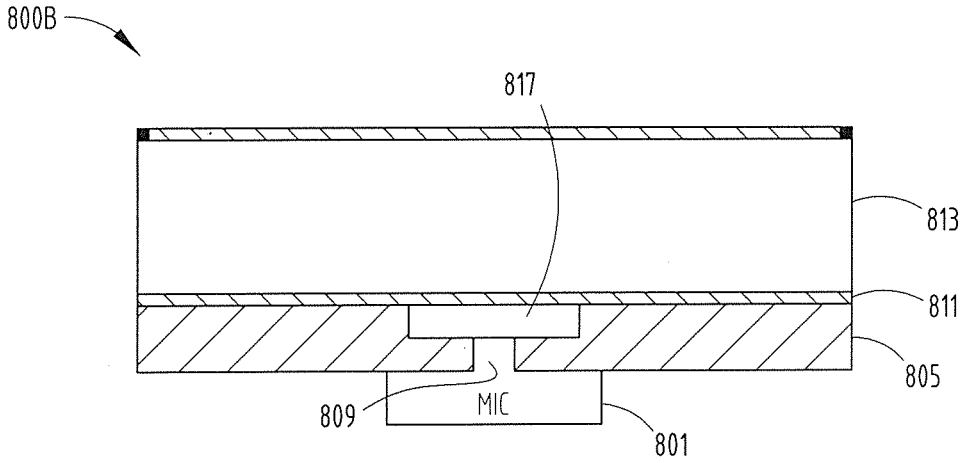

FIGS. 8A and 8B illustrate possible embodiments of the mounting arrangement using the microphone on the printed circuit board. The microphone mounting assembly 800A includes a transducer or microphone 801 as described herein. The mounting assembly further includes a spacer 803 positioned on top of a printed circuit board 805. A channel 807 is formed into the spacer 803 and is positioned above a port 809 having a smaller diameter than the channel 807 formed in the printed circuit board 805. Preferably, the size and shape of the channel 807 and port 809 will be selected to avoid acoustic resonances that can adversely impact performance of the microphone 801. Those skilled in the art will recognize that the form or shape of the port(s) can be multimodal such as an oval shape as compared to circular, square or rectangular shaped ports. In use, the size of the channel 807 and port 809 are often selected so that acoustic resonances are greater than the highest frequency of interest, e.g., 8000 Hz. Further, positioned on the surface of the spacer 803 is a first fabric cover 811 used to disrupt the direct meeting or "encounter" of airflow. In situations where flowing air directly strikes the microphone, this situation often creates an acoustical impulse signal that produces an undesired noise and/or other undesirable sounds from the microphone electrical output.

Thus, the first fabric cover 811 works to prevent this type of encounter with airflow by randomizing the movement of air in the channel 807. Since the first fabric cover 811 operates to isolate the air in the channel 807, the air movement within the channel 807 is damped which ultimately reduces the effect of airflow encounter. Further, a top cover 813 having a resistance greater than one (>1) acoustic ohm is used to protect the first fabric cover 811. A lid or top cover 813 includes a second fabric cover 815 that permits entry of an acoustic wave moving toward the channel 807 while preventing small particles of moisture, dust, debris and/or other foreign objects from gaining access to interior portion 816 under the second fabric cover 815. The embodiment as shown in FIG. 8B differs from FIG. 8A only in that it does not include the spacer 803. In this embodiment, the port 809 can be cut or machined into the printed circuit board 805 for allowing the creation of a pseudo-channel 817. The pseudo-channel 817 is located above the port 809 that is covered by the first fabric cover 811. The pseudo-channel 817 includes a tapered passage 819 that abuts the first fabric cover 811 for allowing the sound and desired sound acoustics to be channeled to the port 809 and microphone 801. At least a top portion of pseudo-channel 817 may also be plated with a metallic material or the like that acts as a shield for preventing ESD from entering the pseudo-channel 817 into the port 809 that may affect microphone performance.

Thus, as seen in the embodiments illustrated in FIGS. 8A and 8B, in order to reduce low frequency noise from wind and air flow, it is often desirable to construct one or more integrating cavities over the transducer microphone. In applications where MEMS transducers are used, the acoustic port or the channel leaded thereto is directly covered with acoustic resistive material for preventing air encounter. Alternatively as seen in FIG. 8B, the actual port hole can be covered in the housing with acoustic resistive material if no spacer is used and the circuit board is machined to accommodate the channel leading to the port. However, this alternative embodiment can have several drawbacks. For example, if the port size is substantially small, it may be occluded by a single water droplet and also is sensitive to small amounts of debris. Small cavities are also less effective for wind and airflow noise reduction. In use, a slot or resistive cloth having a resistance greater than four (>4) acoustic ohms is desirable for wind and airflow reduction.

In yet another alternative embodiment, the cavities can be linked via ducts (not shown) with the correct acoustic inductance, (inertance) such for allowing the formation of a larger integrated cavity at very low frequencies. This larger common cavity can reduce the flowing air induced pressures and the ducts allow the same pressure at every microphone for reducing the difference signal that aids in acoustic signal processing. These ducts being such that in the desired pass band, the cavities will remain separated with the arrival time differences (phase differences) present but at very low frequencies below the pass band the magnitude and difference would be profoundly lower.

In still yet other embodiments, the cloth cover over a thin cavity will create a virtual porting condition where the cloth covered port will change the apparent acoustic port location. This effect can be used to vary the apparent location from the physical location of the microphone porting. This permits locating the transducers on the printed circuit board at locations that are more acoustically conducive for achieving greater efficiency. The use of a larger area cloth covered port would also not only offset the acoustic entry but it will also enable properties that are frequency dependant that can improve overall performance. A long and narrow port with the physical microphone port located at one end will create a line or "shotgun" type microphone that will impart directional properties. This effect can be used to correct the high frequency (HF) verses low frequency (LF) entry differences as well as decreasing the magnitude of the phase and amplitude differences for sounds arriving other than from the desired direction as determined by the porting dimensions. Hydrophobic coated cloth may be used to protect the microphone from water. Additionally, conductive fibers may be incorporated into the cloth for additional ESD and EMI protection. Conductive cloth can be used to protect the electronic circuitry as well as the microphone transducer or transducers. MEMS, capacitor and electret transducers are particularly ESD sensitive and can benefit from the use of conductive cloth.

As individual microphone transducers may have gains that vary by ±3 dB or more, the A/D converter channels have some gain variation as well. The microphone assembly needs a method of gain calibration to meet customer specifications as well as to ensure correct beamformer operation. Prior art systems have been designed to use selected resistors, potentiometers or laser trimming of resistors to trim the microphone gain. Typically gain is measured at a reference frequency of 1 kHz and an overall gain value is calculated to produce the required target sensitivity. One possible calibration method is to measure the gain for each microphone transducer channel and calculate a channel calibration factor which is then stored in non-volatile memory. For still better beamformer performance, the gain or gain and phase can be measured for each FFT/filter bank band. This information can be used to generate individual gain/phase calibration factors for each band which are then stored in non-volatile memory. Alternatively, the nominal beamformer weights can be multiplied by the band gain/phase calibration factors and stored in program or non-volatile memory to avoid extra run time computation.

Vehicle noise levels are quite high and vehicle interiors necessarily contain a large number of acoustically reflective surfaces such as the vehicle windows. This reverberation times are short enough that the subjective result is speech coloration rather than perceptible reverberation. This coloration is often described as a "distant" or "hollow" sound. By incorporating a reverberation model into a microphone beamformer, the speech echoes can be made to correlate with the direct speech energy. At the same time, the vehicle noise becomes decorrelated as it does not fit the acoustic model for the desired speech. This process results in residual noise that can be more effectively removed using stationary noise reduction techniques. Hence, because vehicle interiors are highly reverberant spaces, this typically has been seen as a disadvantage for a mirror mounted microphone. By using a beamformer structure that incorporates a reverberation model, the mirror location can be used to its advantage.

Even with optimized polar patterns, speech signals from the microphone will sound "distant" due to early reflections off interior vehicle surfaces. As the reflections arrive a few milliseconds after the direct sound, they are not perceived as echoes but as a coloration of the speech. By maintaining a frequency bin history buffer and applying complex weights to prior speech frames, an inverse "echo" signal can be calculated and subtracted from the speech. Alternatively, direct speech signal can be delayed and added to the other complex weighted delayed frames. While the echoes cannot be exactly cancelled as they depend on driver position, mirror position and seat position, they can be substantially reduced. Also, the cancellation will be approximate due to finite history buffer length. For the best cancellation the reflection model needs to be tuned to a specific vehicle model.

Space-time beamformers are known in the radar art albeit not in a microphone context. The space-time microphone beamformer substitute microphones for antennas, a FFT or filterbank is inserted after the microphone and the processing blocks become N dimensional where N is the number of bands in the FFT or filterbank. The final result from the microphone beamformer is then transformed using an inverse FFT or filterbank. Alternatively, the microphone beamformer can be described as a standard frequency domain beamformer where the like frequency bins for each microphone are multiplied by a complex weight and then summed. Additionally, frequency bins from prior speech frames are saved and multiplied by complex weights that are summed with the complex weighted current frame.

One method of calculating the complex weights is to use an least means square (LMS) or normalized least means square or proportionate normalized least mean square derived algorithm (NLMS, PNLMS, Affine Projection, etc.) with a close microphone clean speech reference such as a headset. Using an in vehicle recording of the individual microphones in the array along with a simultaneous clean speech signal, a complex adaptive linear combiner can be used to adapt the complex weights to minimize the difference between the processed speech from the array and the headset signal. The values of the complex weights at the end of the training period are saved and used as a fixed space-time beamformer. This process can be repeated for multiple speaker locations in a given vehicle if the clean references are available as for example, the driver and passenger. Multiple beams can be computed output from the microphone (driver/passenger)/passenger 2, . . . ). Alternatively, the best beam signal or the sum of the beam signals can be output to automatically handle drive/passenger switching.

In order to utilize a standard VDA interface, the microphone must typically consume less than 6 mA or 25 mW from the interface power supply. Standard DSP processors often consume far too much power to work with the standard interface. By utilizing signal processing integrated circuits originally designed for use in hearing aids or wireless headsets, the power consumption can be reduced to level compatible with the VDA standard. Still yet another factor in maintaining compatibility with unprocessed analog microphones is to minimize nonlinearities in the processed speech. In U.S. patent application Ser. No. 12/570,615, entitled "A Vehicular Automatic Gain Control (AGC) Microphone System and Method for Post Processing Optimization of a Microphone Signal," commonly assigned to Gentex Corporation, which is herein incorporated by reference in its entirety, any nonlinear processing is substantially confined to the non-speech portions of the signal. This allows the downstream acoustic echo cancellation to function as intended. Also, it is necessary to minimize the speech processing delay to avoid disrupting the downstream acoustic echo cancellation. The total system processing delay should be less than 30 ms for compatibility with a system originally designed for an unprocessed microphone. A metal or metalized shield over the PCB can be used to provide protection from EMI caused by Global System for Mobile (GSM) phones and other interference sources.

The availability of low power silicon microphones also enables the construction of a VDA powered microphone array. Those skilled in the art will further recognize that a VDA or other two-wire interface requires shunt regulation and a means for providing an audio output. Typically, these are combined into a single circuit to provide a signal plus DC level which is modulated to produce an audio output. A shunt regulator or discrete transistor circuits can be used in this application. Alternative approaches can also include AC coupled operational amplifiers and shunt regulation or loading to establish a nominal DC operating point. The transistor and operational amplifier integrated circuit approaches typically have poor DC stability, particularly over temperature. The minimum zero signal DC operating voltage limits the available power for additional processing in a two-wire microphone application shown in FIGS. 5 and 6 herein. Therefore, it is desirable to stabilize the DC operating point. A transistor circuit incorporating a thermistor in its bias network can be used to stabilize the DC bias point as an alternative to a shunt regulator. This method is also tolerant to large variations in the series load resistance such as may occur with different vehicle features or option levels. The approach may also incorporate Safe-Operating-Area (SOA) protection and/or voltage clamping to protect the microphone from shorts to the vehicle power bus.

As the microphone described herein provides improved performance over existing microphones it may be desirable to retrofit vehicles with this improved design. During the installation process, electronic components in the microphone may be exposed to an uncontrolled ESD environment unless additional precautions are taken. In order to protect the microphone assembly it may be necessary to provide additional shielding. The component side of the microphone PCB assembly can be covered with a conductive material such as metal, metalized plastic or conductive plastic. One possible implementation is to use a "SnapShield" manufactured by W.L. Gore Company. The "SnapShield" is a cover manufactured of a thin thermoformed metalized plastic part that snaps over small metal spheres soldered to the PCB. The thin plastic material used in the SnapShield cover is flexible and sized for allowing an interference fit around the microphone connector or other orifice. Optionally, small slits can also be added around any shield or orifice opening to provide additional flexibility.

Figure 9:
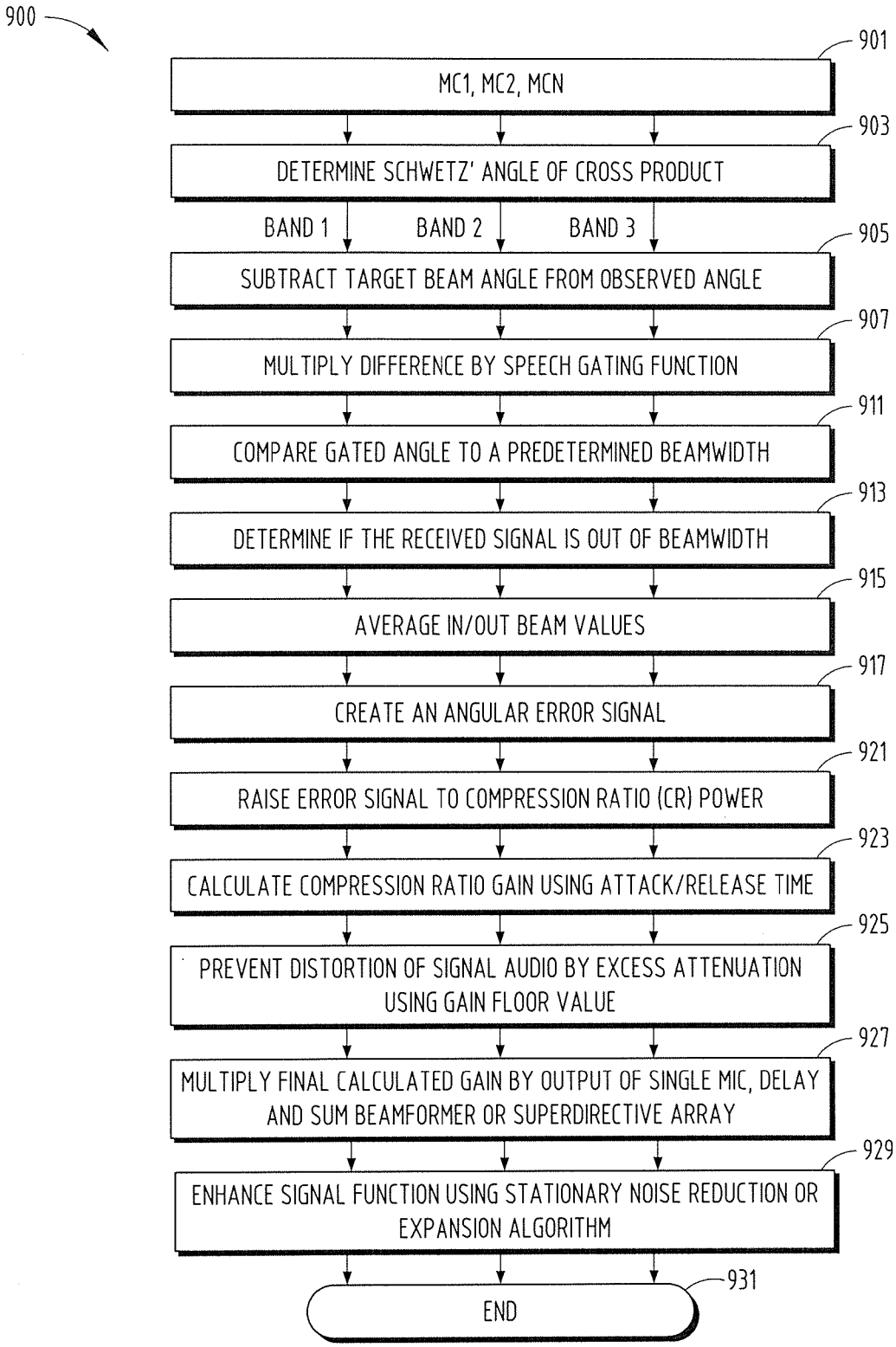
FIG. 9 is a flow chart diagram illustrating a process for microphone noise reduction using angular processing.

FIG. 9 is a flow chart diagram illustrating a process for microphone noise reduction using angular processing. Those skilled in the art will recognize that Aarabi's algorithm can provide a fairly high level of noise reduction but also tends to introduce high levels of distortion and/or artifacts in the remaining processed speech. Also, the Aarabi algorithm requires the computation of the phase angle of each microphone used in the gain calculation. The angle calculation involves computing approximately 2 arctangents per FFT frame which is a microprocessor intensive process requiring rapid and complex mathematical calculations. Moreover, the algorithm does not provide optimum gain since it does not work well in a complex acoustical environment such as a car or other vehicle. This is due to the phase differences between acoustical waves that do not typically follow simple "free space" rules in noise reduction calculations. The algorithm developed by Parham Aarabi et al. is discussed in the publication entitled "Phase-Based Dual-Microphone Robust Speech Enhancement"; IEEE Transactions on Systems, Man, and Cybernetics—Part B Cybernetics, Vol. 34, No. 4; August 2004, pp 1763-1773 and is herein incorporated by reference in its entirety.

The Schwetz algorithm eliminates one of the angle calculations used in the Aarabi algorithm by calculating the angle of the cross product of a microphone pair. Unfortunately, the Schwetz algorithm's gain function is very complex and contains two hypergeometric functions which are generally slow to compute using standard microprocessor techniques. Hence, another embodiment of the present invention is a phase based noise reduction utilizing a novel process for providing improved speech quality and higher levels of noise attenuation than known algorithms. This new embodiment has the added benefit of low mathematical computation requirements as compared with processes used in the prior art. The algorithm as developed by Ingo Schwetz et al. is discussed in the publication "A Cross-Spectrum Weighting Algorithm for Speech Enhancement and Array Processing: Combining Phase-shift Information and Stationary Signal Properties"; Journal of the Acoustical Society of America; 119(2); February 2006, pp 952-964 is also incorporated by reference herein in its entirety.

As seen in FIG. 9, the process for microphone noise reduction using angular processing 900 begins by supplying an output from a plurality of microphones (two or more) 901 to a microprocessor that works to determine the Schwetz angle of the cross product 903. This provides a group of audio frequencies or bins on a "per band" basis that can be independently processed. A "target" beam angle is then subtracted from an observed beam angle 905 to create a "window" upon which audio signal are to be received. This difference is then multiplied by a speech gating angle function 907. This gated angle is then compared to a predetermined beamwidth 911 where it is then determined if the received signal value is inside or outside of the predetermined beamwidth or window. A determination is made if an acoustic signal value falls either inside or outside the window by averaging the acoustic signal in time 915 to create an angular error signal value 917. The angular error signal value is then mathematically adjusted to compression ratio (CR) power 921. The result of the compression ratio calculation is attack/release filtered to determine the gain for that particular frequency group using a gain value 923. Thus, a gain floor can then be applied for preventing distortion caused by signals having too high of an amplitude 925. The final calculated gain is then multiplied by the output of the signal microphone, a delay and sum beamformer microphone array or a superdirective array 927. The resulting signal may be further enhanced by stationary noise reduction or through the use of an expansion algorithm 929 where the completed process ends 931.

Thus, the present invention is generally directed to a microphone mounting assembly for use in an automotive mirror that includes at least directional microphone transducer or at least two omnidirectional transducers mounted over a port in a printed circuit board (PCB) and at least one spacer having a channel formed therein for providing separation between the PCB and port. A first cover is positioned over the channel while a top section having a second cover formed therein is used for preventing debris from contacting the first cover. Acoustical energy will propagate though the first cover and second cover into the channel and into the port such that the first cover disrupts a direct encounter with airflow into the channel for preventing acoustic noise at the microphone transducer. Further, a process for microphone noise reduction using a phase based calculation is used for providing enhanced speech quality and a higher level of noise attenuation with minimized signal processing requirements.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A microphone mounting assembly comprising:

at least one transducer mounted to a printed circuit board (PCB);

at least one spacer having a channel positioned on the PCB for allowing acoustical energy to pass through the channel to a port in the PCB;

a first cover positioned over the channel for disrupting the direct encounter with airflow into the channel; and a top section having a second cover positioned adjacent to the first cover for preventing debris from obstructing the first cover.

2. A microphone mounting assembly as in claim 1, wherein the diameter of the port is smaller than the diameter of the channel.

3. A microphone mounting assembly as in claim 1, wherein the microphone is positioned over the port on the PCB.

4. A microphone mounting assembly as in claim 1, wherein the first cover and the second cover are manufactured from a textile fabric.

5. A microphone mounting assembly as in claim 1, wherein the second cover uses only a portion of the cover surface.

6. A microphone mounting assembly as in claim 1, wherein the microphone mounting assembly is used with an automotive mirror housing.

7. A microphone mounting assembly as in claim 1, wherein a top portion of the channel is plated for preventing ESD from affecting microphone performance.

8. A microphone mounting assembly as in claim 1, wherein the at least one transducer is electrically aimed substantially at the driver's side window for providing optimal performance.

9. A microphone mounting assembly as in claim 6, wherein the automotive mirror housing is associated with a windshield console.

10. A microphone mounting assembly for use in an automotive mirror comprising:

at least one microphone transducer mounted over a port in a printed circuit board (PCB);

at least one spacer having a channel formed therein for providing separation between the PCB and port;

a first cover positioned over the channel;

a top section having a second cover formed therein for preventing debris from contacting the first cover; and wherein acoustical energy propagates though the first cover and second cover into the channel and into the port such that the first cover disrupts a direct encounter with airflow into the channel for preventing acoustic noise.

11. A microphone mounting assembly as in claim 10, wherein the diameter of the port is smaller than the diameter of the channel.

12. A microphone mounting assembly as in claim 10, wherein the microphone is positioned substantially over the port on the PCB.

13. A microphone mounting assembly as in claim 10, wherein the first cover and the second cover are manufactured from a textile fabric.

14. A microphone mounting assembly as in claim 10, wherein the spacer has a greater thickness than the PCB.

15. A microphone mounting assembly as in claim 10, wherein an interior chamber is formed between the first cover and second cover.

16. A microphone mounting assembly as in claim 10, wherein a top portion of the channel is plated for preventing ESD from affecting performance of the at least one microphone.

17. A microphone mounting assembly as in claim 10, wherein the at least one transducer is electrically pointed substantially at the driver's side window.

18. A microphone mounting assembly as in claim 10, wherein the automotive mirror is associated with a windshield console.

19. A method for forming a microphone mounting assembly for use in an automotive mirror comprising the steps of:

mounting at least one microphone transducer over a port in a printed circuit board (PCB);

utilizing a spacer having a channel formed therein for providing separation between the PCB and the port;

positioning a first cover over the channel for disrupting the direct encounter with airflow into the channel for preventing acoustic noise at the microphone; and mounting a top lid, having a second cover formed therein, over the first cover for preventing debris from contacting the first cover.

20. A method for forming a microphone mounting assembly as in claim 19, further comprising the step of:

forming the port with a smaller diameter than that of the channel.

21. A method for forming a microphone mounting assembly as in claim 19, further comprising the step of:

positioning the microphone substantially over the port on the PCB.

22. A method for forming a microphone mounting assembly as in claim 19, further comprising the step of:

using a first cover and second cover that are manufactured from a textile fabric.

23. A method for forming a microphone mounting assembly as in claim 19, further comprising the step of:

using a spacer have a greater thickness than the PCB.

24. A method for forming a microphone mounting assembly as in claim 19, further comprising the step of:

forming an interior chamber between the first cover and second cover.

25. A method for forming a microphone mounting assembly as in claim 19, further comprising the step of:

forming a plated surface at a top portion of the channel for preventing ESD from affecting microphone performance.

26. A method for forming a microphone mounting assembly as in claim 19, wherein the at least one microphone transducer is electrically pointed substantially at the driver's side window.

27. A method for forming a microphone mounting assembly as in claim 19, further comprising the step of:

forming the automotive mirror is association with a windshield console.

* * * * *